US006302724B1

(12) United States Patent
Meller

(10) Patent No.: US 6,302,724 B1
(45) Date of Patent: Oct. 16, 2001

(54) CABLE CONNECTOR HAVING STRAIN RELIEF

(75) Inventor: Andrew G. Meller, Hertogenbosch (NL)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/355,472

(22) PCT Filed: Jan. 30, 1998

(86) PCT No.: PCT/US98/01874

§ 371 Date: Apr. 14, 2000

§ 102(e) Date: Apr. 14, 2000

(87) PCT Pub. No.: WO98/34302

PCT Pub. Date: Aug. 6, 1998

Related U.S. Application Data

(60) Provisional application No. 60/031,312, filed on Jan. 30, 1997.

(51) Int. Cl.[7] ..... H01R 13/58

(52) U.S. Cl. ..... 439/457; 439/942; 439/701

(58) Field of Search ..... 439/457, 456, 439/458, 460, 459, 942, 701

(56) References Cited

U.S. PATENT DOCUMENTS

| | | | | |
|---|---|---|---|---|
| H113 | * | 8/1986 | McNeel | 439/458 |
| 2,027,853 | * | 1/1936 | Benander | 439/456 |
| 2,713,669 | * | 7/1955 | Cahn | 439/457 |

* cited by examiner

*Primary Examiner*—Brian Sircus
*Assistant Examiner*—Javaid Nasri
(74) *Attorney, Agent, or Firm*—Steven M. Reiss; M. Richard Page

(57) ABSTRACT

A cable connector which includes a concave housing having opposed planar sides and a relation between the planar sides and having a proximate opening and a distal opening and first and second interior axial walls. A cable extends through the proximate opening in the exterior wall of the concave housing toward the distal opening and diverges adjacent the distal opening of the housing into opposed first and second transverse cable extensions. A terminal block is mounted in the distal opening of the housing having first and second projections and each of the projections engage one of the interior axial walls of the housing and one of the transverse cable extensions. Metallic contacts also extend from the terminal block to be electrically connected to the transverse cable extensions.

16 Claims, 8 Drawing Sheets

CABLE CONNECTOR HAVING STRAIN RELIEF

This application is a 371 of PCT/US98/01876 Jan. 30, 1998 which claims benefit of 60/031/312 Jan. 30, 1997.

BACKGROUND OF THE INVENTION

1. Field of the Invention

The present invention is related to electrical connectors and more particularly to cable connectors.

2. Brief Description of Prior Developments

FIG. 1 shows the current method of making a charger cable connector. This prior art charger cable connector kit includes a top cover 10, a bottom cover 12, a V-90 male connector 14, a paddle board 16 and a cable 18. It also includes lateral latches 20 and 22 and buttons 24 and 26. To achieve the strain relief, a flexible grommet is molded onto the cable.

To grip the grommet, a two piece cover is used, that is closed around the grommet, and secured by screwing or riveting the two covers together, trapping the grommet, the terminal block, and the cable connector metal latches.

When the cable is pulled, the force is transmitted from the copper wires, through the insulation, to the grommet. The grommet then transmits the force to the cover body. The cover body transmits the force to the metal latches, which transmit the force to the body of the mating connector which, for this connector, is located in the case of a mobile telephone. This procedure avoids a situation in which force is transmitted to either the solder joints or the contacts.

The grommet does not prevent all forces from being transmitted to the solder joints or contacts particularly when the cable is flexed. Sometimes, however, a paddle board is used to further relieve the forces which will be transmitted to an individual contact to spread the forces over a larger number of electrically non-functional contacts.

The paddle board is used particularly with miniature connectors, where the strength and retention of the contact in the housing is small compared to the forces which can be applied to the cable in the use of such a product.

Disadvantages of the above described apparatus are as follows.

The number of components used means a high investment in tooling, a high material cost, and a labor intensive assembly process.

For a cable type B to work effectively, the adhesion between the copper wires and the insulation, and the insulation and the jacket, must be extremely high. Otherwise, when the cable is pulled, the insulation and jacket will stretch, and the force will be conducted via the copper wires direct to the solder joints and contacts, resulting in either a broken solder joint, or a displaced contact or paddle board, if used.

If, however, the cable is made with very high insulation and jacket adhesion, it becomes very difficult to strip during the assembly process, and becomes less flexible, making it less user friendly for the end user.

It is an object of the present invention to provide a cable connector which avoids the above described disadvantages.

SUMMARY OF THE INVENTION

The present invention is a cable connector assembly which includes a concave housing comprising a proximate cable receiving opening and a distal terminal block opening and an interior retaining block engagement means. A cable extends axially through the proximate cable receiving opening into the concave housing. A transverse cable extension is adjacent the distal block opening. A terminal block has an axial projection and a metallic contact and is mounted in the distal retaining block opening of the concave housing such that the projection engages the interior block retaining means and the projection and contact engage the transverse cable extension.

Preferably, the terminal block has a primary strain relief groove, which the wire is placed into from above. The plastic housing squeezes the insulation of the wires onto the copper, holding the wire into position in the terminal block. This holds the parts in position while the wire is soldered to the contact, and also functions as a strain relief, isolating forces from the solder joint.

Further, when the housing is preferably fitted to the terminal block, by sliding it forward, a ramp in the cover pushes a secondary strain relief tongue towards the cable, and finally clamps the cable insulation (or jacket in the case of cable type B) firmly to the housing. Plastic barbs in the secondary strain relief tongue also exert a locally high pressure to the cable jacket, clamping the jacket to the insulation, to the copper wires.

The housing is also preferably held in position against the terminal block by means of a latching device. The housing is shaped at the back to provide an area where the cable is restrained in a straight length, so that any cable flexing forces will only be seen as an axial force at the point where the cable is clamped to the cover. Further, the cable exit portion of the housing is provided with a radiused edge, to avoid any cutting of the cable jacket by repeated flexing.

The housing also preferably incorporates plastic latches, which will transmit the forces from the cable to the mating connector. The plastic latches are molded with a bias, and are squeezed inwards while the cover is assembled to the terminal block. When the latches are released, the flanges on each side of the main latch body rest against pre-load guide in the terminal block. This ensures that the latches always have a pre-load force holding them against the terminal block, thus eliminating a large part of the effect of manufacturing tolerances on the latch depression force.

BRIEF DESCRIPTION OF THE DRAWINGS

The present invention is further described with reference to the accompanying drawings in which.

DETAILED DESCRIPTION OF THE PREFERRED EMBODIMENTS

Figure 1:
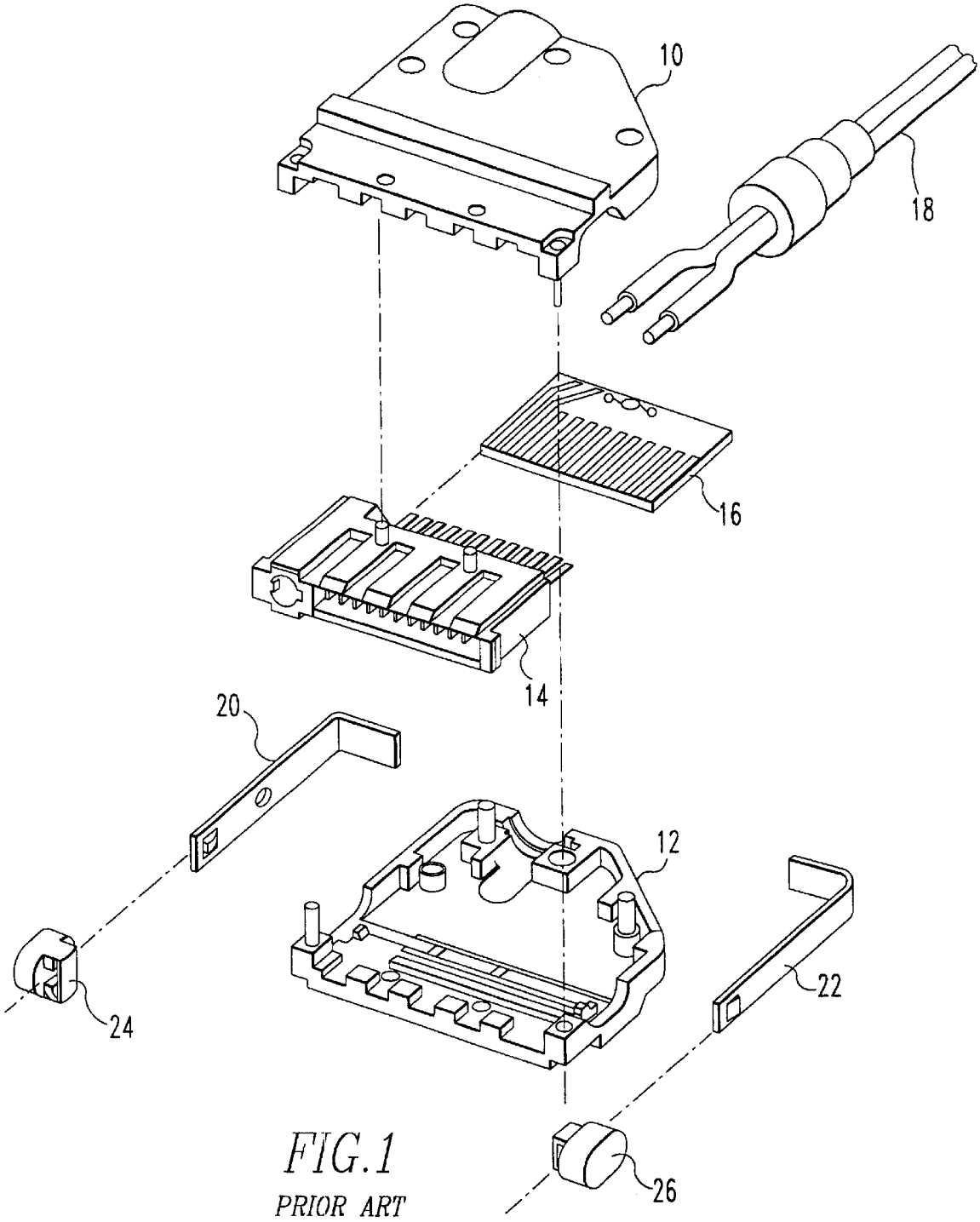
FIG.1 PRIOR ART
FIG. 1 is an exploded perspective view of a prior art charger cable connector kit.

Referring to FIGS. 2–9, the connector assembly includes a concave housing 28 which has a planar top side 30, a planar bottom side 32 which are connected by vertical medial wall 34. In this housing there is proximate opening 36 and a transverse distal opening 38.

Figure 7:
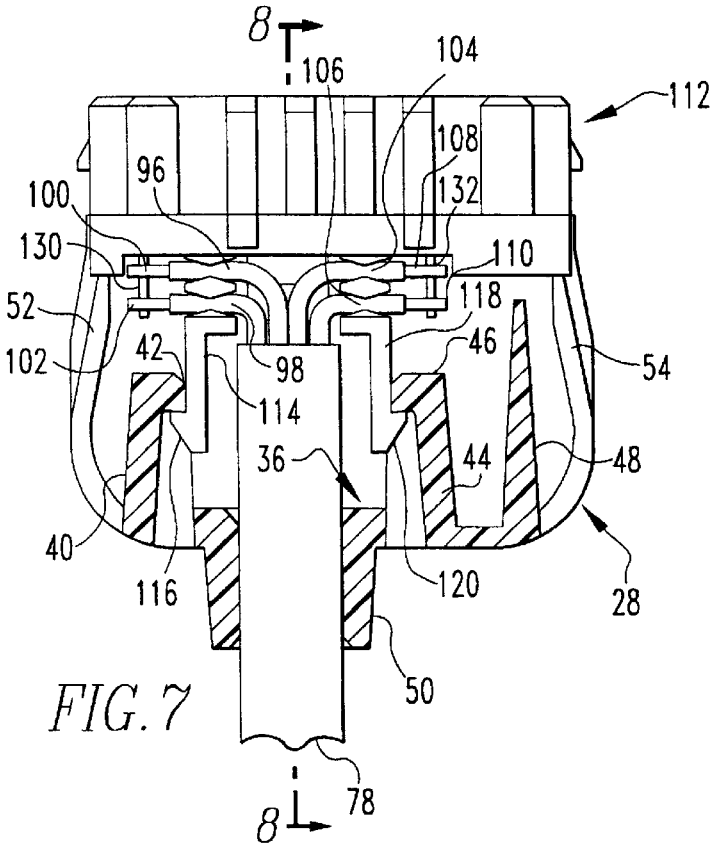
FIG. 7 is a plan cutaway view of the assembled cable connector shown in FIG. 6.

Referring particularly to FIG. 7, the housing also includes an axial interior wall 40 which has a transverse projection 42 and a second spaced axial interior wall 44 which has a transverse projection 46. The housing also includes a third axial interior wall 48 and a proximate opening seal 50. There are also lateral latches 52 and 54.

Figure 8:
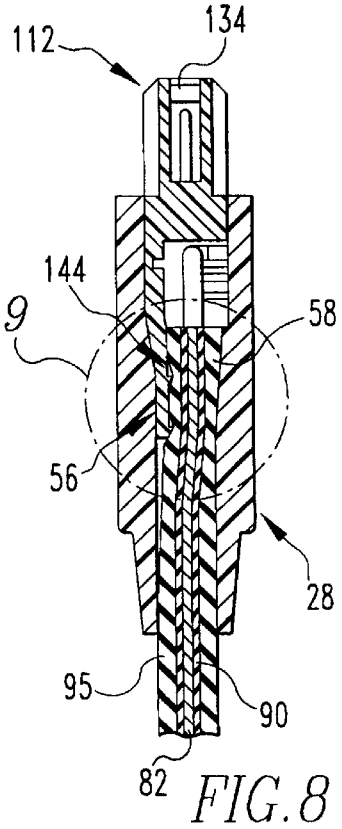
FIG. 8 is a cross sectional view through 8—8 in FIG. 7.
Figure 9:
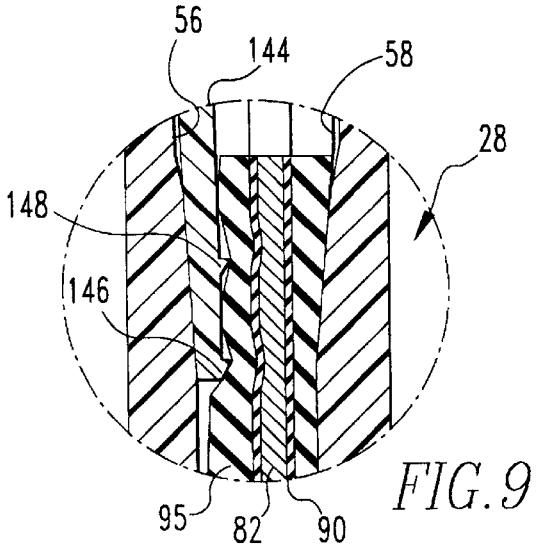
FIG. 9 is a detailed view of circle 9 in FIG. 8.

Referring particularly to FIGS. 8 and 9, the housing has a lower interior inclined surface 56 and an upper interior surface 58. This lower interior surface 56 may be considered to be an actuator ramp as is further explained hereafter.

Figure 2:
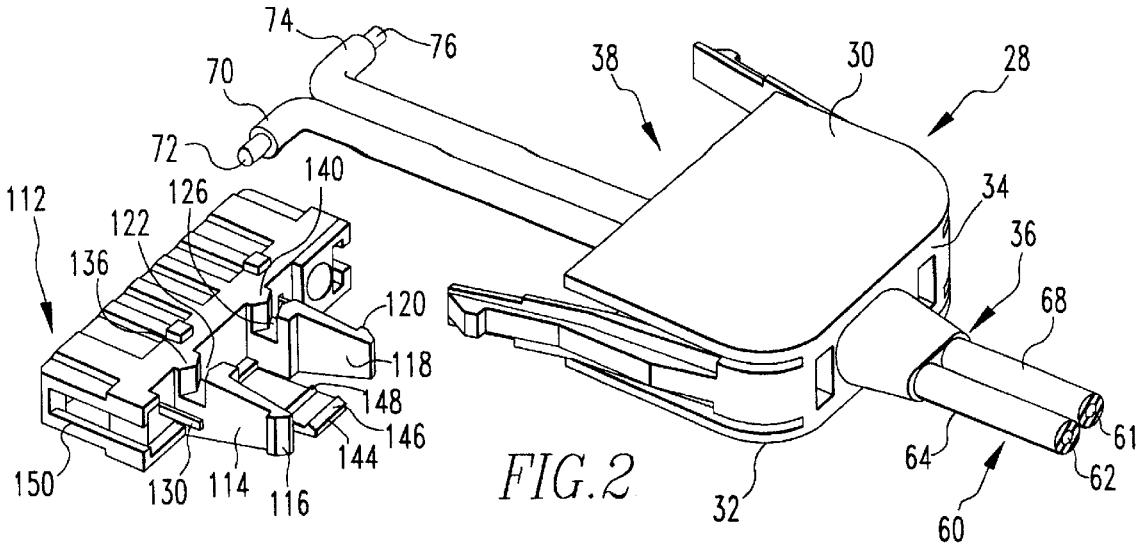
FIG. 2 is a perspective view of a disassembled cable connector representing a preferred embodiment of the present invention.
Figure 3:
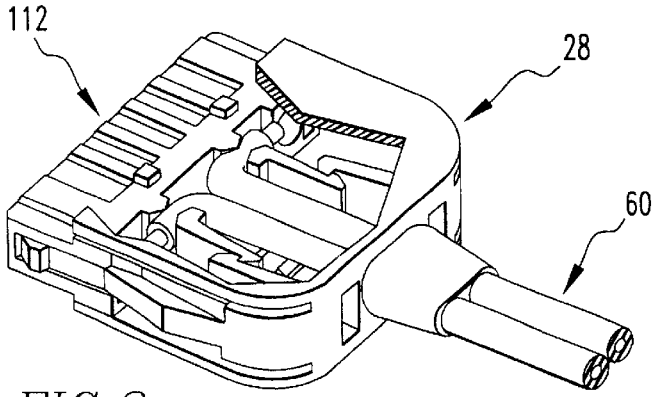
FIG. 3 is a perspective view of a disassembled cable connector assembly representing another preferred embodiment of the present invention.
Figure 4:
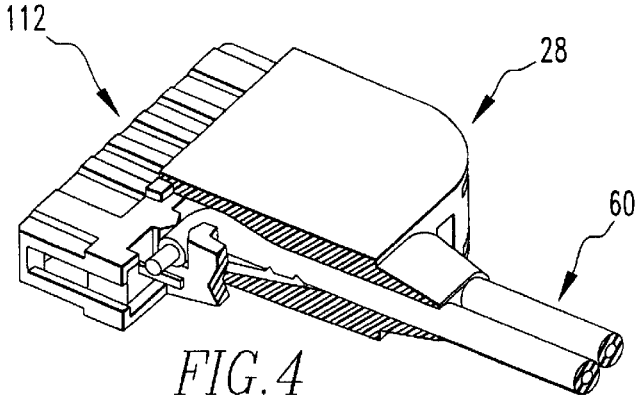
FIG. 4 is a top cutaway perspective view of the assembled cable connector shown in FIG. 2.

Referring to FIGS. 2–4, in the first embodiment of the connector assembly, there is a cable type A which is shown generally at numeral 60. This cable type A includes a conductor 62 with surrounding insulation 64 and a second conductor 61 with its surrounding insulation 68. At the distal end of the cable 60 type A it has a transverse extension 70 with a solder tail 72 and an opposed transverse extension 74 with its solder tail 76.

Referring to FIGS. 5–9, the second embodiment of the cable connector is shown. It will be understood that this embodiment is essentially identical to the first embodiment except that there is a minor adaptation to accommodate the inclusion of a cable type B which is shown generally at numeral 78. This cable type B includes four conductors 80, 82, 84 and 86 and their respective insulation layers 88, 90, 92 and 94 and an outer cable jacket 95. At its terminal end the cable type B has parallel transverse extensions 96 and 98 and their respective solder tails 100 and 102. In the opposed direction the cable type B also has parallel transverse extensions 104 and 106 and their respective solder tails 108 and 110.

Referring again generally to FIGS. 2–9, both embodiments include a terminal block shown generally at the numeral 112. It will be understood from the following description that these terminal blocks are essentially identical except for a minor accommodation necessary to engage the additional set of transverse extensions in the cable type B. The blocks each have an axial projection 114 with a lateral extension 116 and a spaced parallel axial projection 118 which also has a lateral extension 120.

Referring particularly to FIG. 7, it will be seen that the lateral extension 116 on projection 114 engages transverse projection 42 on the axial interior wall 40 of the concave housing. It will also be seen that the lateral extension 120 on axial projection 118 engages the lateral projection 46 on the axial interior wall 44. On both embodiments of the connector cable there is a transverse groove 122 on projection 114 which engages a transverse extension of the cable. On the cable type B embodiment there is also a second transverse groove 124 which engages the second parallel transverse extension of the cable type B. Similarly, in both embodiments there is a transverse groove 126 on projection 118 which engages the opposed transverse extension of the cable and in the cable type B embodiment there is a second groove 128 which engages the second parallel transverse extension. The terminal block also includes contacts 130 and 132 which are electrically connected to the solder tails of the transverse extensions of the cables.

Referring particularly to FIG. 8, the terminal block has distal openings as at opening 134 to allow electrical connection to the contacts as at 130 from the opposed side of the terminal block.

Figure 5:
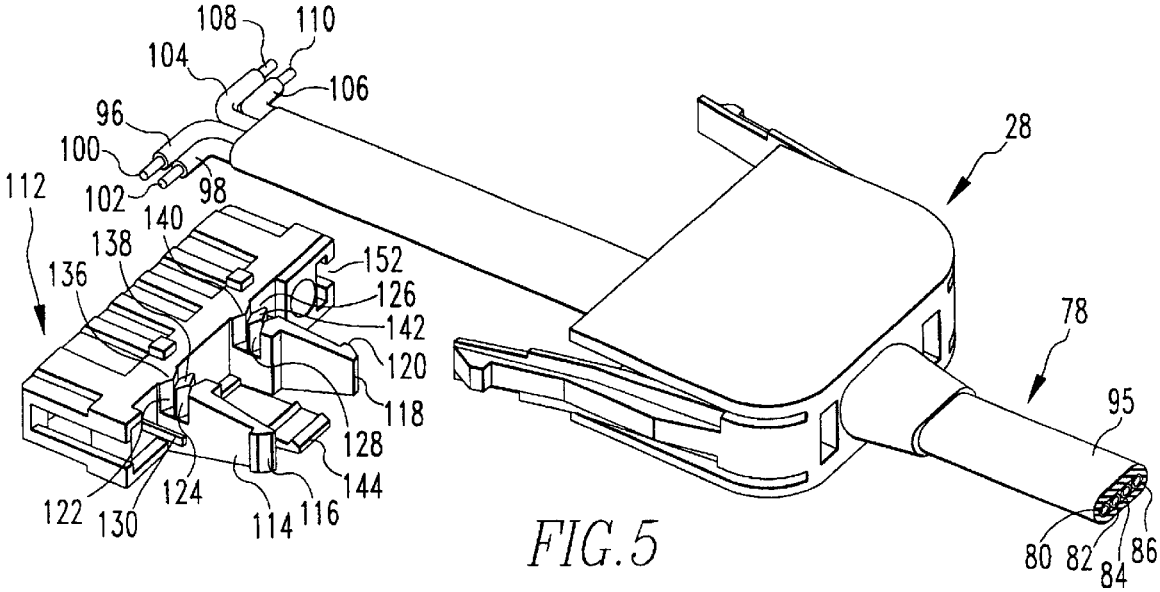
FIG. 5 is a side cutaway perspective view of the assembled cable connector shown in FIG. 2.
Figure 6:
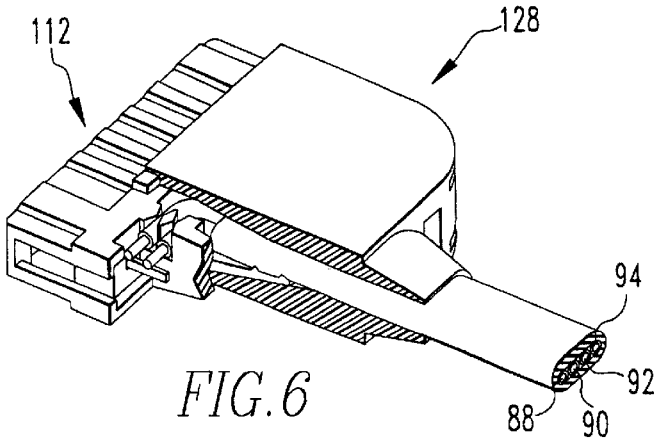
FIG. 6 is a side cutaway perspective view of the assembled cable connector shown in FIG. 5.

Referring particularly to FIGS. 2 and 5, it will also be seen adjacent grooves 122 and 124 there are convex primary strain relief features 136 and 138 for the transverse extensions of the cable. Similarly, adjacent grooves 126 and 128 there are primary strain relief features 140 and 142 which serve the same purpose for the transverse cable extensions in the opposed direction.

Referring again to FIGS. 2–9 generally, it will be seen that the terminal block also includes an axial tongue 144 which extends into the concave housing. This tongue 144 has a pair of spaced transverse barbs 146 and 148 which serve as secondary strain relief features as is further explained as follows.

Referring particularly to FIGS. 8 and 9, it will be seen that this tongue 144 is interposed between the cable 78 and the lower interior inclined surface 56 of the housing in contacting relation with both the lower surface of the housing and the cable. (While not shown with cable 60, it will be understood that the same arrangement is used with that cable.) It will also be seen that the barbs 146 and 148 grip the insulative layer of the cable to affect a secondary strain relief function. Referring particularly to FIGS. 2–6 it will be seen that the terminal block also includes latch guide grooves 150 and 152 for receiving, respectively, latches 52 and 54.

Referring to FIGS. 10*a*–11*d*, a method for assembling the cable connector of the present is illustrated. In FIGS. 10*a*–10*d* the assembly of the cable type A embodiment is illustrated. The assembly of the cable type B is illustrated in FIGS. 11*a*–11*d*. Except for this difference, however, the two embodiments of this method are essentially identical.

Figure 10A:
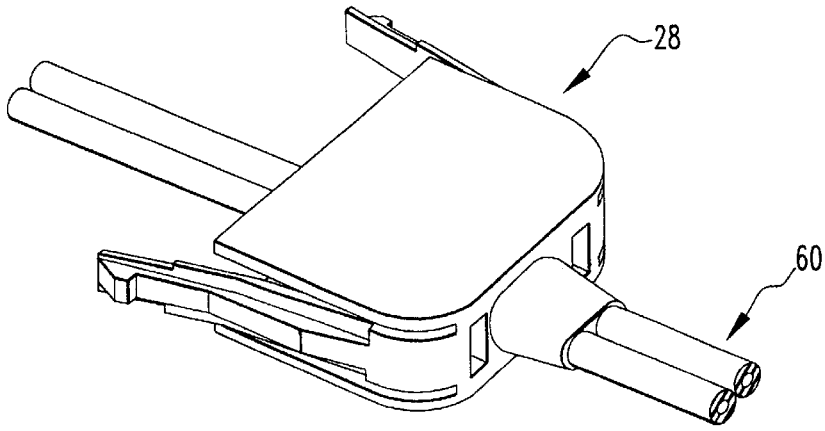
FIGS. 10*a*–10*d* are perspective views illustrating steps in the method of assembling the cable connector shown in FIGS. 2–4.
Figure 10B:
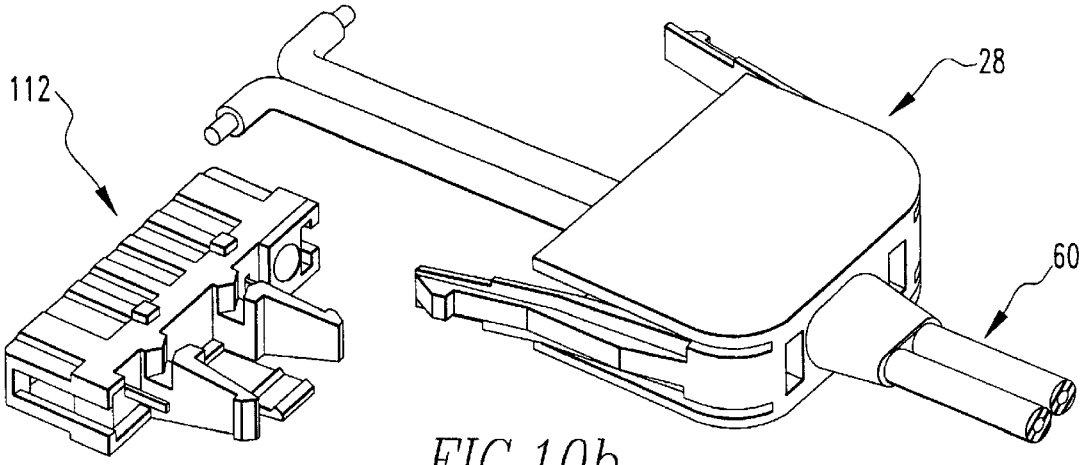
Figure 10C:
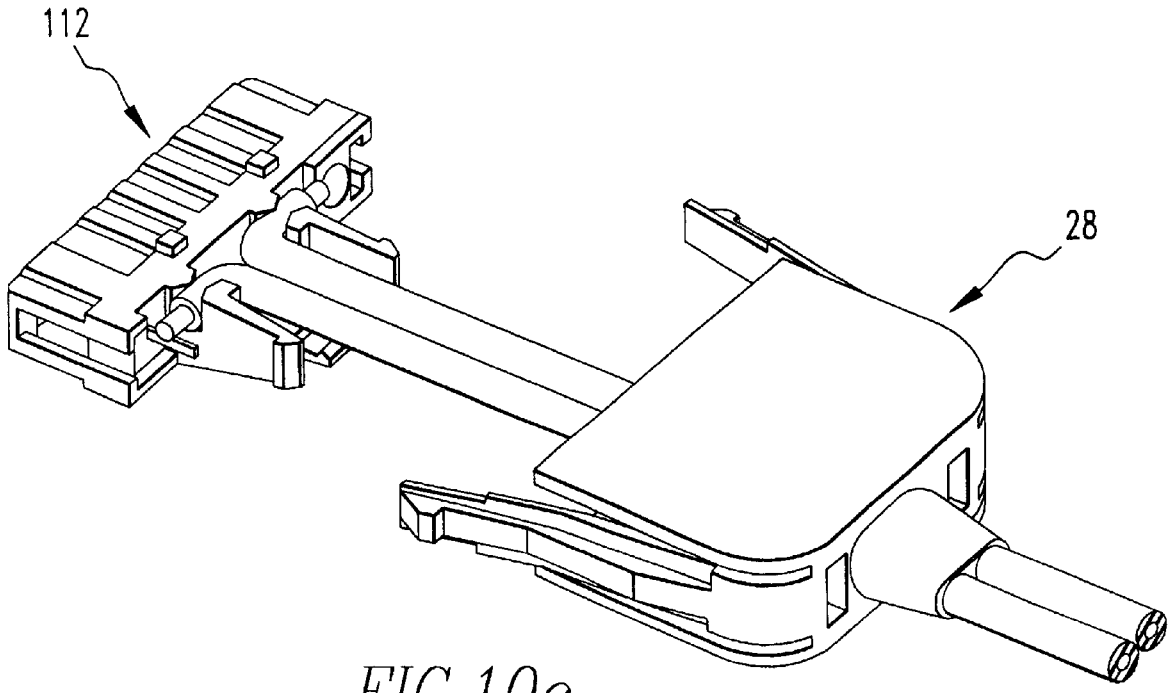
Figure 10D:
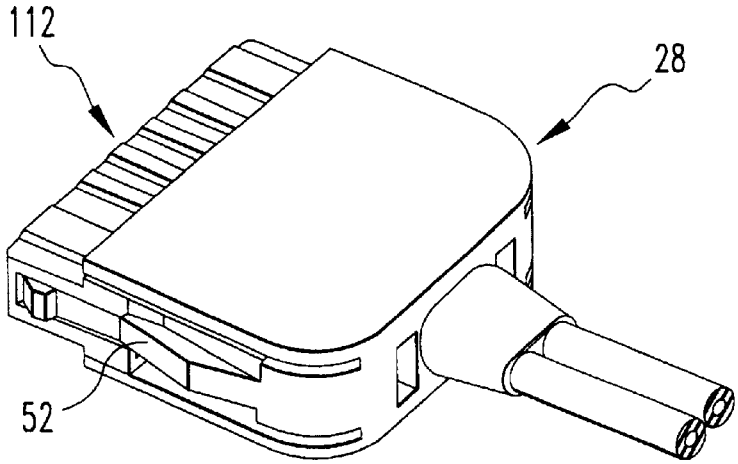
Figure 11A:
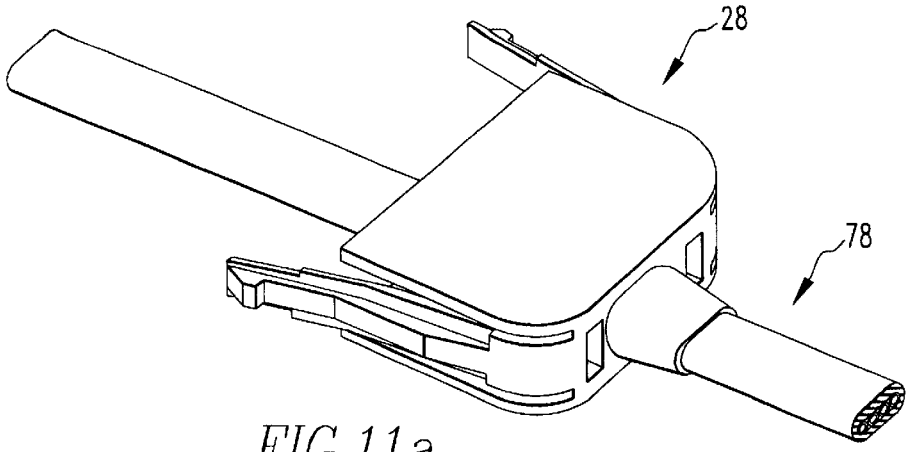
FIGS. 11*a*–11*d* are perspective views illustrating steps in the method of assembling the cable connector shown in FIGS. 5–9.
Figure 11B:
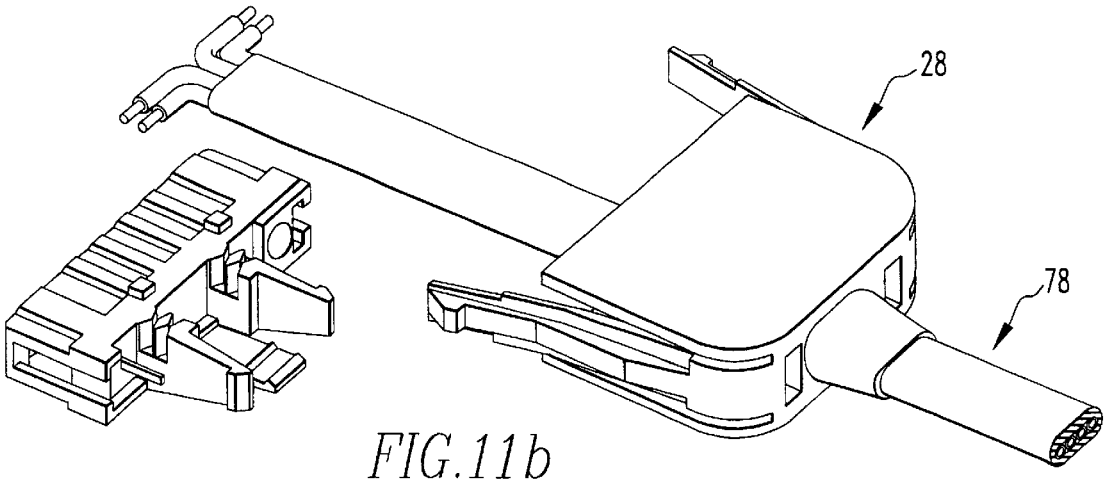
Figure 11C:
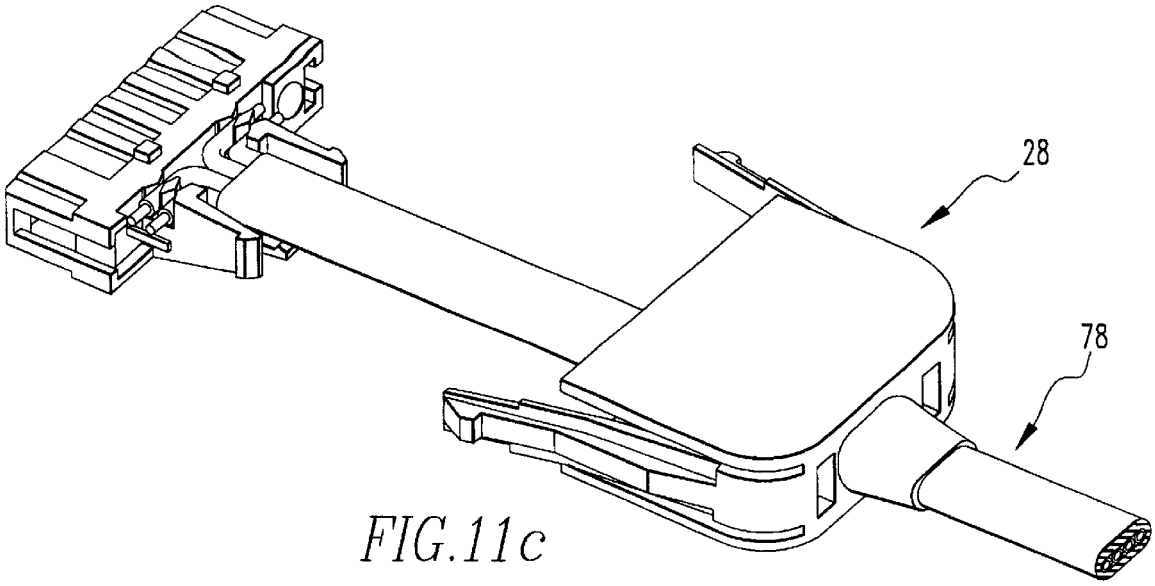
Figure 11D:
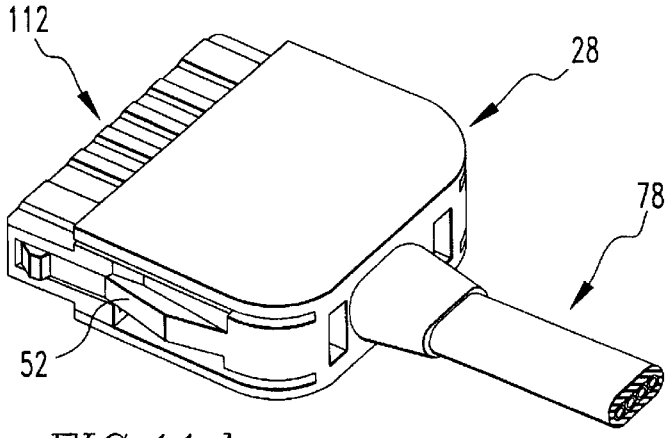

Referring to FIGS. 10*a* and 11*b*, in the first step of this method the concave housing 28 is slid over either the cable type A 60 (FIG. 10*a*) or the cable type B 78 (FIG. 11*a*). In FIGS. 10*b* and 11*b* the second step of the method is illustrated in which the cable is stripped and its wires are spread to form transverse extensions 70 and 74 (FIG. 10*b*) or transverse extensions 70, 74, 76 and 78 (FIG. 11*b*). In FIG. 10*c*, the third step in assembling the cable type A embodiment is shown in which the transverse extensions 70 and 74 are positioned in the transverse grooves 122 and 126 of projections 114 and 118. In this step the solder tails 72 and 76 are also connected to the contacts 130 and 132. Similarly, in FIG. 11*c* the third step in assembling the cable type B embodiment is shown in which the transverse extensions 70, 74, 96 and 98 are positioned in the grooves 122, 124, 126 and 128 and the solder tails 72 and 100 are connected to contact 130 while solder tail 76 and 102 are connected to contact 132. The final step of this method is illustrated in FIGS. 10*d* and 11*d* in which it is shown that the lateral latches 52 and 54 on the housing are squeezed inwardly so as to allow them to slide in the pre-load guides of the terminal block. This action causes the housing to slide over the terminal block and causes the terminal block projections 114 and 118 to engage the interior walls 40 and 42 in the way shown in FIG. 7. This action also causes the tongue 114 to engage the cable as at 78 and the lower interior inclined surface 56 in the way shown in FIGS. 8 and 9.

It will be appreciated that a cable connector has been provided which reduces the number of components, integrating the function of strain relief into the terminal block, and providing a secondary strain relief which is actuated by the cover during the assembly process.

It will also be appreciated that the cable connector described herein will be particularly useful for mobile I/O uses.

Those skilled in the art will appreciate that this invention may be applicable to other types of devices. In particular, an aluminum cable or a flat ribbon cable or any combination of flat and round cables may be substituted for the copper cable. It will also be appreciated that the fixture and holding means described herein may be applicable to optical cables and optical wave guides.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A cable connector comprising:

(a) a concave housing comprising opposed planar sides and an exterior wall extending in normal relation between the planar sides and having a proximate opening and a distal opening and first and second interior axial walls;

(b) a cable extending through the proximate opening in the exterior wall of the concave housing toward the distal opening and diverging adjacent the distal opening of the housing into opposed first and second transverse cable extensions; and (c) a terminal block mounted in the distal opening of the housing having first and second strain relief projections each of said projections engaging one of the interior axial walls of the housing and one of the transverse cable extensions.

2. The cable connector of claim 1 wherein first and second metallic contacts extend from the terminal block and said first and second metallic contacts are electrically connected respectively to the first and second transverse cable extensions.

3. The cable connector of claim 2 wherein the terminal block has at least one distal opening so as to allow access to at least one of the metallic contacts.

4. The cable connector assembly of claim 1 wherein the distal opening is transversely elongated.

5. The cable connector assembly of claim 1 wherein the projections of the terminal block each have at least one transverse groove which engages one of the transverse cable extensions.

6. The cable connector assembly of claim 5 wherein the projections of the terminal block each engage a plurality of transverse cable extensions.

7. The cable connector assembly of claim 5 wherein the second interior wall has a terminal lateral projection which engages a terminal lateral projection on the second projection of the terminal block and the second transverse cable extension is engaged by said second projection.

8. The cable connector assembly of claim 1 wherein the first interior wall has a terminal lateral projection which engages a terminal lateral projection on the first projection of the terminal block and the first transverse cable extension is engaged by said first projection.

9. The cable connection assembly of claim 1 wherein a tongue extends from the terminal block in medial relation between said first and second projections to engage the cable.

10. The cable connector assembly of claim 9 wherein one of the planar sides of the housing has an inclined inner surface and the tongue bears against said inclined inner surface.

11. The cable connector assembly of claim 10 wherein the inclined inner surface is inclined downwardly toward the distal opening.

12. The cable connector assembly of claim 11 wherein the tongue has at least one barb that grips the cable.

13. The cable connector assembly of claim 1 wherein opposed lateral latching means fix the terminal block onto the concave housing.

14. A cable connector comprising:

a concave housing comprising a proximate cable receiving opening and a distal opening and an interior terminal block retaining means;

a cable extending axially through the proximate cable receiving opening into the concave housing and having a transverse cable extension adjacent the distal opening;

a terminal block having a generally axial projection and being mounted in the distal opening of the concave housing such that the axial projection engages the interior block retaining means and the transverse cable extension;

wherein a tongue extends from the terminal block into the concave housing to engage the cable.

15. A cable connector comprising:

a concave housing comprising a proximate cable receiving opening and a distal opening and an interior terminal block retaining means;

a cable extending axially through the proximate cable receiving opening into the concave housing and having a transverse cable extension adjacent the distal opening;

a terminal block having a generally axial projection and being mounted in the distal opening of the concave housing such that strain relief projections engage the interior block retaining means and the transverse cable extension;

wherein there is at least one metallic contact and said contact is electrically connected to the transverse cable extension;

wherein there is a pair of spaced parallel strain relief projections which extend into the housing to be fixed to the interior terminal block retaining means.

16. A method for assembling a cable connector comprising the steps of:

positioning a cable relative to a concave housing having a proximate opening and a distal opening and a terminal block engagement means such that the cable passes through said proximate and distal openings;

splitting said cable adjacent the distal opening of the housing to form a pair of opposed transverse cable extensions;

positioning a terminal block having at least one axial projection adjacent the distal opening of the housing and engaging at least one of said cable extensions with the terminal block projection;

causing the terminal block projection to be engaged with the terminal block engagement means in the concave housing;

wherein the terminal block has a tongue which engages the cable.

* * * * *